US010013911B2

(12) United States Patent
Wu et al.

(10) Patent No.: US 10,013,911 B2
(45) Date of Patent: Jul. 3, 2018

(54) DRIVING METHOD AND DRIVING CIRCUIT OF DISPLAY PANEL AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Qian Wu, Beijing (CN); Fan Li, Beijing (CN); Ronghua Lan, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 69 days.

(21) Appl. No.: 14/762,661

(22) PCT Filed: Nov. 11, 2014

(86) PCT No.: PCT/CN2014/090804

§ 371 (c)(1),
(2) Date: Jul. 22, 2015

(87) PCT Pub. No.: WO2015/196701

PCT Pub. Date: Dec. 30, 2015

(65) Prior Publication Data

US 2016/0253955 A1 Sep. 1, 2016

(30) Foreign Application Priority Data

Jun. 26, 2014 (CN) ..... 2014 1 0299674

(51) Int. Cl.
*G09G 5/10* (2006.01)
*G09G 3/3208* (2016.01)
(Continued)

(52) U.S. Cl.
CPC ..... *G09G 3/3208* (2013.01); *G09G 3/20* (2013.01); *G09G 3/2003* (2013.01);
(Continued)

(58) Field of Classification Search
CPC .. G09G 3/3208; G09G 3/3225; G09G 3/3275; G09G 3/20; G09G 3/32; G09G 2330/021; G09G 2320/0626
(Continued)

(56) References Cited

U.S. PATENT DOCUMENTS

2001/0052888 A1* 12/2001 Hebiguchi ..... G09G 3/3666 345/87
2002/0063671 A1* 5/2002 Knapp ..... G09G 3/3666 345/87
(Continued)

FOREIGN PATENT DOCUMENTS

CN 1577442 A 2/2005
CN 1604164 A 4/2005
(Continued)

OTHER PUBLICATIONS

3rd office action issued in corresponding Chinese application No. 201410299674.6 dated Sep. 26, 2016.
(Continued)

*Primary Examiner* — Srilakshmi K Kumar
*Assistant Examiner* — Chineyere Wills-Burns
(74) *Attorney, Agent, or Firm* — Nath, Goldberg & Meyer; Joshua B. Goldberg

(57) ABSTRACT

The present invention provides a driving method and a driving circuit of a display panel and a display device. The display panel comprises: gate lines and data line and pixel units, the data lines comprises: first data lines and second data lines, and a first predetermined number of first data line(s) and a second predetermined number of second data
(Continued)

line(s) are alternately arranged. The driving method comprises a step of: scanning the gate lines in turn, wherein when scanning one gate line, a data voltage signal is applied to the first data lines or the second data lines. Compared to the driving method in the prior art, the driving method provided by the present invention allows lower power consumption of the OLED panel when display at the same brightness is achieved.

10 Claims, 7 Drawing Sheets

(51) Int. Cl.
*G09G 3/3225* (2016.01)
*G09G 3/3275* (2016.01)
*G09G 3/20* (2006.01)

(52) U.S. Cl.
CPC ..... *G09G 3/3225* (2013.01); *G09G 3/3275* (2013.01); *G09G 2300/0426* (2013.01); *G09G 2310/0281* (2013.01); *G09G 2320/0626* (2013.01); *G09G 2330/021* (2013.01)

(58) Field of Classification Search
USPC ..... 345/690
See application file for complete search history.

(56) References Cited

U.S. PATENT DOCUMENTS

2005/0265400 A1* 12/2005 Shin ..... G09G 3/325 370/540
2009/0289878 A1* 11/2009 Chen ..... G09G 3/3688 345/87
2010/0171734 A1 7/2010 Chiu
2013/0088479 A1* 4/2013 Kim ..... G09G 3/3614 345/212
2013/0271357 A1 10/2013 Wang
2014/0077725 A1* 3/2014 Lee ..... H05B 37/02 315/312

FOREIGN PATENT DOCUMENTS

| | | | |
|---|---|---|---|
| CN | 1702727 | A | 11/2005 |
| CN | 1770237 | A | 5/2006 |
| CN | 201266288 | Y | 7/2009 |
| CN | 102237030 | A | 11/2011 |
| CN | 103606360 | A | 2/2014 |
| CN | 103855192 | A | 6/2014 |
| CN | 104103240 | A | 10/2014 |
| EP | 0 759 605 | A1 | 2/1997 |
| JP | 2003-5152 | A | 1/2003 |
| KR | 10-2006-0038846 | A | 5/2006 |
| TW | 559772 | B | 11/2003 |

OTHER PUBLICATIONS

International Search Report dated Apr. 1, 2015 issued in corresponding International Application No. PCT/CN2014/090804 along with an English translation of the Written Opinion of the International Search Authority.
Office Action dated Oct. 28, 2015 issued in corresponding Chinese Application No. 201410299674.6.
Office Action dated Apr. 5, 2016 issued in corresponding Chinese Application No. 201410299674.6.
European Search Report dated Nov. 10, 2017 issued in corresponding application No. 14891119.1.

* cited by examiner

DRIVING METHOD AND DRIVING CIRCUIT OF DISPLAY PANEL AND DISPLAY DEVICE

This is a National Phase Application filed under 35 U.S.C. 371 as a national stage of PCT/CN2014/090804 filed on Nov. 11, 2014, an application claiming the benefit to Chinese application No. 201410299674.6 filed on Jun. 26, 2014; the content of each of which is hereby incorporated by reference in its entirety.

FIELD OF THE INVENTION

The present invention relates to the field of display technology, and particularly relates to a driving method and a driving circuit of a display panel as well as a display device.

BACKGROUND OF THE INVENTION

Organic Light Emitting Diodes (OLEDs) are one of the hotspots in the research field of flat-panel displays nowadays, and compared to thin film transistor liquid crystal displays (TFT-LCDs), OLED displays have advantages such as low power consumption, low manufacturing cost, self-luminescence, wide visual angle, quick response and the like.

In an OLED, organic material is controlled to emit light by way of current driving. Specifically, an OLED panel comprises a plurality of pixel units, each of which comprises: a switching tube, a driving TFT and an OLED. When the switching tube is turned on through the gate line corresponding to a pixel unit, the data line corresponding to the pixel unit transfers a data voltage signal to the gate of the driving TFT, and the driving tube generates a corresponding driving current according to the data voltage signal to control the organic material in the OLED to emit light.

Currently, when using an OLED panel for reading electronic books or pages of words, certain damage may be caused to human eyes, as the OLED panel has a very high brightness, and the high brightness will lead to relatively high power consumption of the OLED panel.

To solve the above problem, in the prior art, the driving current generated by the driving tube is generally reduced by adjusting data voltage value of the data voltage signal, so as to reduce the display brightness of the OLED. However, it has been found in practical operation that, when the brightness of the OLED panel is reduced by reducing the driving current, the power consumption of the OLED panel cannot be significantly reduced. For example, when the brightness of the OLED panel is reduced to a half of the normal brightness, the corresponding power consumption of the OLED panel cannot be reduced to a half of the power consumption when the OLED panel is of the normal brightness.

SUMMARY OF THE INVENTION

An object of the present invention is to provide a driving method and a driving circuit of a display panel, and a display device, in order to effectively reduce both brightness and power consumption of the display panel on the premise that the image display quality of the display panel is ensured.

To achieve the above object, the present invention provides a driving method of a display panel, wherein the display panel comprises: a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged; the driving method comprises a step of:

scanning the plurality of gate lines in turn, wherein when scanning one gate line, a data voltage signal is applied to the first data lines or the second data lines.

Preferably, each pixel unit is connected to the data line located at a first side thereof; and the step of scanning the plurality of gate lines in turn, wherein when scanning one gate line, a data voltage signal is applied to the first data lines or the second data lines comprises:

scanning the plurality of gate lines in turn, wherein when scanning an odd-numbered gate line, the data voltage signal is applied to the first data lines; and when scanning an even-numbered gate line, the data voltage signal is applied to the second data lines; or scanning the plurality of gate lines in turn, wherein when scanning an odd-numbered gate line, the data voltage signal is applied to the second data lines; and when scanning an even-numbered gate line, the data voltage signal is applied to the first data lines.

Preferably, the pixel unit in an odd row is connected to the data line at a first side thereof, the pixel unit in an even row is connected to the data line at a second side thereof, and the first side and the second side are the two sides of the pixel unit opposite to each other; and the step of scanning the plurality of gate lines in turn, wherein when scanning one gate line, a data voltage signal is applied to the first data lines or the second data lines comprises:

scanning the plurality of gate lines in turn, wherein when scanning each gate line, the data voltage signal is applied to the first data lines; or scanning the plurality of gate lines in turn, wherein when scanning each gate line, the data voltage signal is applied to the second data lines.

Preferably, the first predetermined number is equal to the second predetermined number.

Preferably, the first predetermined number is 1, 2 or 3; and the second predetermined number is 1, 2 or 3.

Preferably, the first predetermined number is 1, and the second predetermined number is 1.

To achieve the above object, the present invention provides a driving circuit of a display panel, for driving the display panel, wherein the display panel comprises: a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged; and the driving circuit of a display panel comprises: a gate line driving circuit connected to the plurality of gate lines, and a data line driving circuit connected to the first data lines and the second data lines;

the gate line driving circuit is configured to apply a scanning signal to the gate line for scanning; and the data line driving circuit is configure to apply a data voltage signal to the first data lines or the second data lines when one of the gate lines is being scanned.

Preferably, the data line driving circuit comprises: a first data line driving sub-circuit and a second data line driving sub-circuit, the first data line driving sub-circuit is configured to apply a data voltage signal to the first data lines; and the second data line driving sub-circuit is configured to apply a data voltage signal to the second data lines.

To achieve the above object, the present invention provides a display device, which comprises a display panel and a driving circuit, wherein the display panel comprises: a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged; and the driving circuit comprises any one of the above driving circuit of a display panel.

The present invention achieves the beneficial effects as follows.

In the driving method and driving circuit of a display panel provided by the present invention, the driving method is used for driving the display panel, the display panel comprises a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged, and the driving method comprises a step of: scanning the plurality of gate lines in turn, wherein when scanning one gate line, a data voltage signal is applied to the first data lines or the second data lines. In the present invention, a case in which the display panel is an OLED panel is taken as an example, the driving method provided by the present invention can allow the pixel units on the OLED panel to display alternately, and since the area of each pixel unit is relatively small with respect to the area of the whole OLED panel, such alternate display manner has a relatively small effect on the image display quality of the OLED panel. Meanwhile, compared to the driving method in the prior art, the driving method provided by the present invention allows lower power consumption of the OLED panel when display at the same brightness is achieved.

DETAILED DESCRIPTION OF THE EMBODIMENTS

To make a person skilled in the art better understand the technical solutions of the present invention, a driving method and a driving circuit of a display panel are described in detail below in conjunction with the accompanying drawings.

The first embodiment of the present invention provides a driving method of a display panel, and the driving method is used for driving the display panel. It should be noted that, this embodiment is described by taking an OLED panel as an example of the display panel, but the driving method provided by this embodiment is not limited to be applicable to the OLED panel.

The OLED panel comprises: a plurality of gate lines and a plurality of data lines, which define a plurality of pixel units, each of which is connected to one of the gate lines and one of the data lines, the data lines comprises: a plurality of first data lines and a plurality of second data lines, and a first predetermined number of first data line(s) and a second predetermined number of second data line(s) are alternately arranged; the driving method comprises a step of: scanning the plurality of gate lines in turn, wherein when scanning one gate line, a data voltage signal is applied to the first data lines or the second data lines only.

In this embodiment, as only the first data lines or the second data lines are applied with the data voltage signal when scanning one gate line, only a part of the pixel units perform display, among the pixel units in one row (i.e., the pixel units connected to said one gate line). Compared with the method of controlling the driving current adopted in the prior art, the driving method provided by this embodiment can allow lower power consumption under the condition that the OLED panel achieves the same display brightness.

In this embodiment, the first predetermined number may be 1, 2 or 3, and the second predetermined number may also be 1, 2 or 3. To ensure the display effect of the OLED panel, the first predetermined number and the second predetermined number may be a relatively small value.

Preferably, the first predetermined number is equal to the second predetermined number, the first predetermined number is 1, and the second predetermined number is also 1.

The driving method provided by the present invention is described in detail below by way of a second embodiment.

Figure 1:
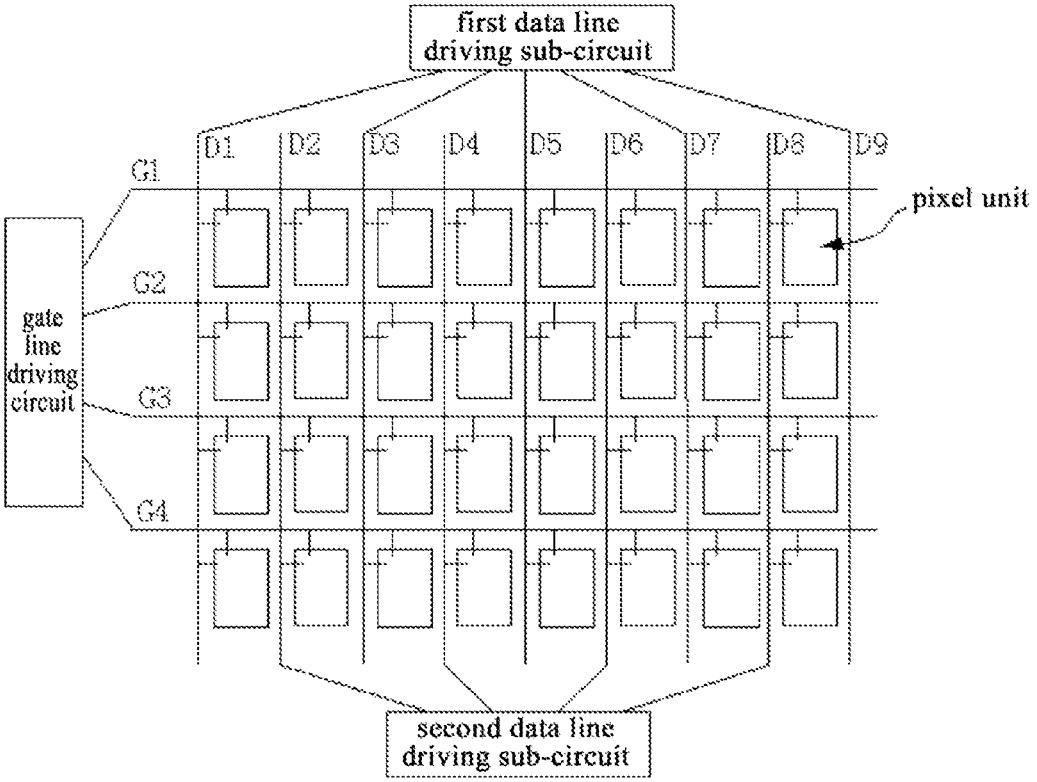
FIG. 1 is a schematic diagram of an OLED panel provided by the present invention.

FIG. 1 is a schematic diagram of an OLED panel provided by the embodiment of the present invention. As shown in FIG. 1, the OLED panel comprises: a plurality of gate lines G1 to G4 and a plurality of data lines D1 to D9, the plurality of gate lines G1 to G4 and the plurality of data lines D1 to D9 define a plurality of pixel units, each of which is connected to one of the gate lines and one of the data lines. The plurality of data lines specifically comprises: a plurality of first data lines D1, D3, D5, D7 and D9 and a plurality of second data lines D2, D4, D6 and D8, and in FIG. 1, one first data line and one data line are alternately arranged. Specifically, the first data line D1, the second data line D2, the first data line D3, the second data line D4, the first data line D5, the second data line D6, the first data line D7, the second data line D8, and the first data line D9 are sequentially provided.

It should be noted that, only a part of the gate lines and a part of the data lines are illustrated in FIG. 1, and those skilled in the art should understand that the OLED panel in FIG. 1 comprises but is not limited to the above numbers of gate lines and data lines.

In the OLED panel, the gate lines may be connected to a gate line driving circuit, the first data lines and the second data lines may be connected to a data line driving circuit, respectively. As a preferable embodiment, the data line driving circuit may comprise: a first data line driving sub-circuit connected to the first data lines and a second data line driving sub-circuit connected to the second data lines. The first data line driving sub-circuit is configured to apply a data voltage signal to the first data lines, and the second data line driving sub-circuit is configured to apply a data voltage signal to the second data lines.

Figure 2:
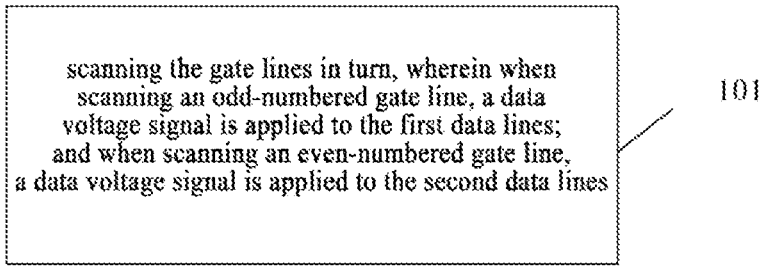
FIG. 2 is a flowchart of a driving method of the display panel shown in FIG. 1, provided by a second embodiment of the present invention.
Figure 3:
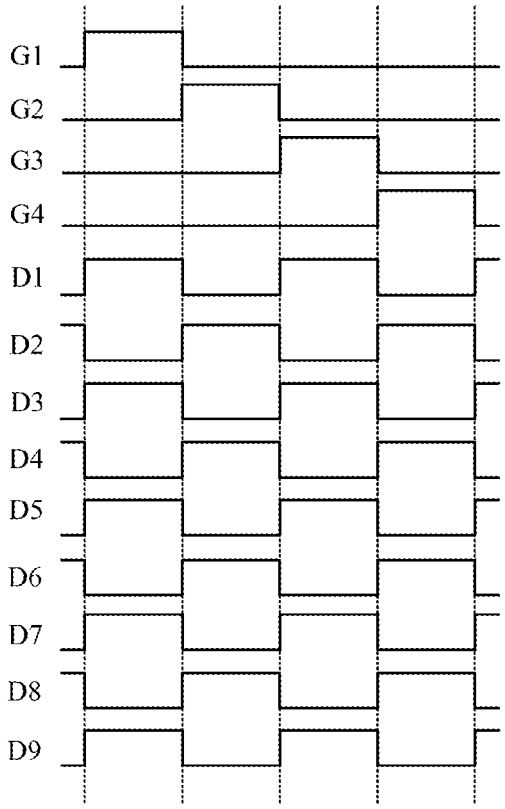
FIG. 3 is a timing diagram of the driving method shown in FIG. 2.

In addition, in the OLED panel shown in FIG. 1, each pixel unit is connected to the gate line located thereabove and the data line located at a first side (i.e., left side) thereof. Specifically, the pixel units in the first row are all connected to the gate line G1, and pixel units in the second row are all connected to the gate line G2, the pixel units in the third row are all connected to the gate line G3, and the pixel units in the fourth row are all connected to the gate line G4; the pixel units in the first column are all connected to the first data line D1, the pixel units in the second column are all connected to the second data line D2, the pixel units in the third column are all connected to the first data line D3, the pixel units in the fourth column are all connected to the second data line D4, and so on. FIG. 2 is a flowchart of a driving method of the display panel shown in FIG. 1, provided by the second embodiment of the present invention, and FIG. 3 is a timing diagram of the driving method shown in FIG. 2. As shown in FIGS. 2 and 3, the driving method shown in FIG. 2 is applicable to the OLED panel shown in FIG. 1, and the driving method comprises:

step 101: scanning the gate lines G1 to G4 in turn, wherein when scanning an odd-numbered gate line (e.g., G1 or G3), the data voltage signal is applied to the first data lines; and when scanning an even-numbered gate line (e.g., G2 or G4), the data voltage signal is applied to the second data lines.

Specifically, description will be given by taking the OLED panel shown in FIG. 1 as an example. The driving method provided by this embodiment comprises: scanning the gate lines G1 to G4 in turn.

When scanning the first gate line G1, the gate line driving circuit outputs a scanning signal to the gate line G1 to turn on the gate line G1, while the other gate lines are turned off. At this point, the pixel units in the first row (i.e., the pixel units connected to the gate line G1) are all in a data writable state. The first data line driving sub-circuit applies a data voltage signal to the first data lines D1, D3, D5, D7 and D9, while the second data line driving sub-circuit does not work, that is, no data voltage signal is applied to the second data lines D2, D4, D6 and D8. Therefore, among the pixel units in the first row, the data voltage can be written into the pixel units in odd columns (i.e., the first, third, fifth and seventh columns) only, and the pixel units in odd columns can perform display, whereas no data voltage can be written into the pixel units in even columns, and accordingly, the pixel units in even columns cannot perform display.

It should be noted that, in FIG. 3, a high-level in the gate line denotes that a scanning signal is applied to the corresponding gate line, and a low-level denotes that no scanning signal is applied to the corresponding gate line. A high-level in the data line denotes that a data voltage signal is applied to the corresponding data line, and a low-level denotes that no data voltage signal is applied to the corresponding data line.

When scanning the second gate line G2, the gate line driving circuit outputs a scanning signal, which is a high-level signal, to the gate line G2 to turn on the gate line G2, while the other gate lines are turned off. At this point, the pixel units in the second row (i.e., the pixel units connected to the gate line G2) are all in a data writable state. The second data line driving sub-circuit applies a data voltage signal to the second data lines D2, D4, D6 and D8, while the first data line driving sub-circuit does not work, that is, no data voltage signal is applied to the first data lines D1, D3, D5, D7 and D9. Therefore, among the pixel units in the second row, the data voltage can be written into the pixel units in even columns (i.e., the second, fourth, sixth and eighth columns) only, and the pixel units in even columns can perform display, whereas no data voltage can be written into the pixel units in odd columns, and accordingly, the pixel units in odd columns cannot perform display.

When scanning the third gate line G3, the gate line G2 is turned on, only the first data line driving sub-circuit works, while the second data line driving sub-circuit does not work, therefore, among the pixel units in the third row, only the pixel units in odd columns can perform display, and the specific process is the same as the process of scanning the gate line G1 as described above and is not repeated herein.

When scanning the fourth gate line G4, the gate line G4 is turned on, only the second data line driving sub-circuit works, while the first data line driving sub-circuit does not work, therefore, among the pixel units in the fourth row, only the pixel units in even columns can perform display, and the specific process is the same as the process of scanning the gate line G2 as described above and is not repeated herein.

Figure 4:
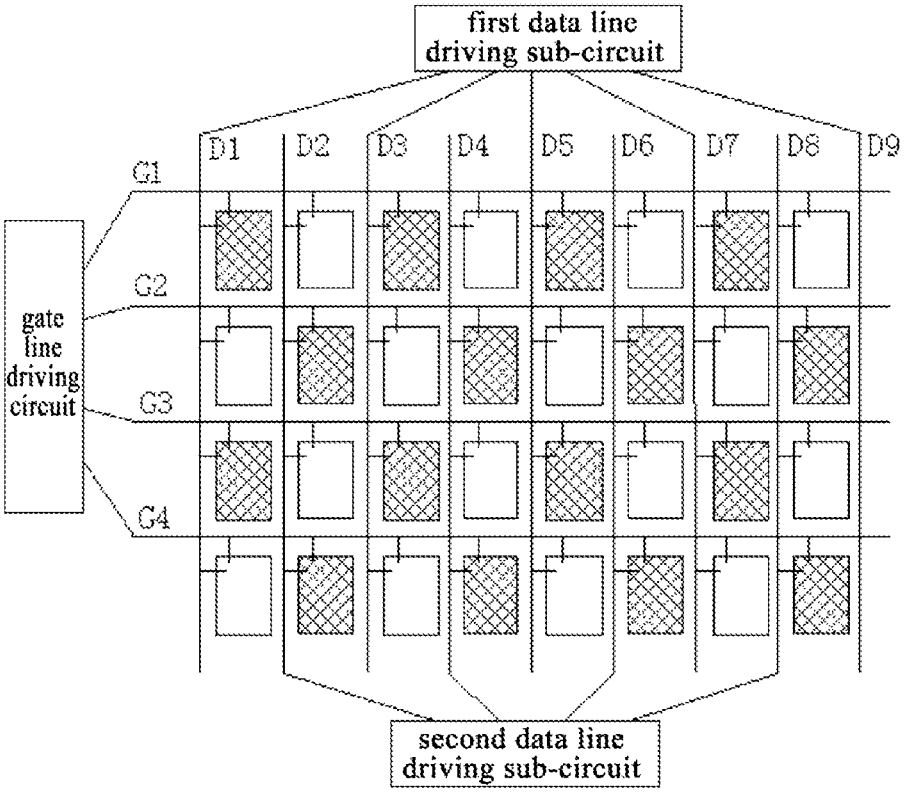
FIG. 4 is a schematic diagram illustrating an effect of driving the OLED panel shown in FIG. 1 by using the driving method shown in FIG. 2.

FIG. 4 is a schematic diagram illustrating an effect of driving the OLED panel shown in FIG. 1 by using the driving method shown in FIG. 2. As shown in FIG. 4, on the OLED panel, the pixel units in odd rows and odd columns and the pixel units in even rows and even columns (the blocks with checks in FIG. 4) can perform display, whereas the pixel units in odd rows and even columns and pixel units in even rows and odd columns (the blocks without checks in FIG. 4) cannot perform display.

Of course, when scanning the odd-numbered gate line (e.g., G1 or G3), a data voltage signal may be applied to the second data lines only; while when scanning the even-numbered gate line (e.g., G2 or G4), a data voltage signal may be applied to the first data lines only. In this case, on the OLED panel shown in FIG. 4, the pixel units in odd rows and odd columns and the pixel units in even rows and even columns (the blocks with checks in FIG. 4) cannot perform display, whereas the pixel units in odd rows and even columns and pixel units in even rows and odd columns (the blocks without checks in FIG. 4) can perform display.

On the premise of achieving the same brightness, power consumption of the OLED corresponding to the driving method provided by this embodiment is compared to that corresponding to the driving method in the prior art.

Figure 5:
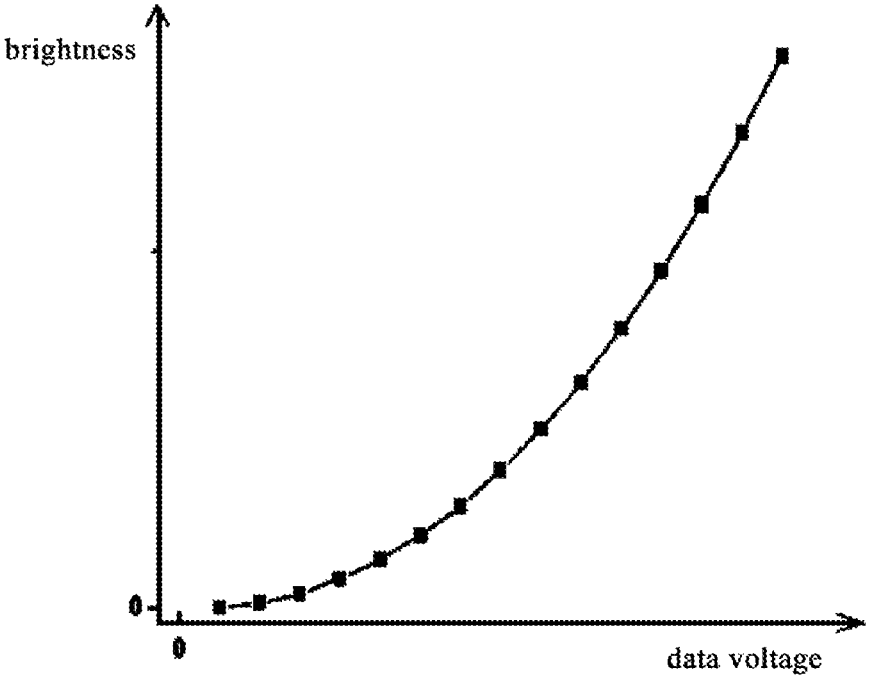
FIG. 5 is a graph illustrating correspondence between a data voltage applied to a single pixel unit and a brightness generated by the pixel unit.
Figure 6:
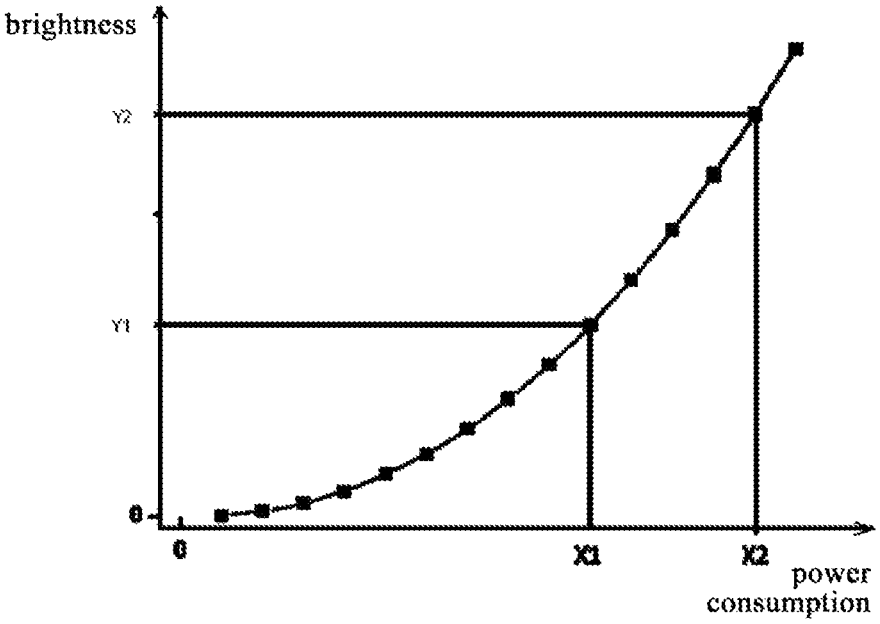
FIG. 6 is a graph illustrating correspondence between power consumption and generated brightness of a single pixel unit.

FIG. 5 is a graph illustrating correspondence between a data voltage applied to a single pixel unit and a brightness generated by the pixel unit, and FIG. 6 is a graph illustrating correspondence between power consumption of a single pixel unit and brightness generated by the pixel unit. In FIG. 5, the abscissa axis represents a data voltage value applied to the pixel unit and ordinate axis represents a brightness value generated by the pixel unit. It can be seen from FIG. 5 that, the correspondence between data voltage and brightness is a convex function. In FIG. 6, the abscissa axis represents a power consumption of the pixel unit, and the abscissa axis represents a brightness value generated by the pixel unit. It can be seen from FIG. 6 that, the correspondence between power consumption and brightness of the pixel unit is also a convex function.

In this embodiment, it is assumed that the normal display brightness of each pixel unit is Y2, the corresponding data voltage is Z2 and the corresponding power consumption is X2. A half of the normal display brightness of each pixel unit is Y1, the corresponding data voltage is Z1 and the corresponding power consumption is X1. Since the correspondence between power consumption and brightness of the pixel unit satisfies a convex function, the following relations can be deduced:

$$Y1 = \frac{1}{2}Y2,\ Z1 > \frac{1}{2}Z2 \text{ and } X1 > \frac{1}{2}X2.$$

For the purpose of exhibiting a half of the normal display brightness on the whole OLED panel, if the method of reducing data voltage in the prior art is adopted for driving, the total power consumption of the OLED panel is mX1 (wherein, m is the number of the pixel units on the OLED panel); if the driving method provided by the present embodiment is adopted for driving, only a half of the pixel units (for example, the pixel units in odd rows and odd columns and pixel units in even rows and even columns) in the display panel display normally, and accordingly, the total power consumption of the OLED panel in the present embodiment is $$\frac{1}{2}mX2.$$

Since $$X1 > \frac{1}{2}X2,$$

it can be deduced that $$mX1 > \frac{1}{2}mX2.$$

Therefore, by using the driving method provided by this embodiment, the power consumption is lower under the premise of the same brightness.

It should be noted that, the driving method provided by this second embodiment is merely a preferable implementation of the present invention, and is not intended to limit the technical solutions of the present invention. Those skilled in the art should understand that the following variations also fall within the protection scope of the present invention: in practical applications, when scanning the odd-numbered gate line, the second data line driving sub-circuit applies a data voltage signal to the second data lines, and when scanning an even gate line, the first data line driving sub-circuit applies a data voltage signal to the first data lines; alternatively, when scanning one of the particular gate lines, the first data line driving sub-circuit applies a data voltage signal to the first data lines, and when scanning one of the remaining gate lines, the second data line driving sub-circuit applies a data voltage signal to the second data lines.

The second embodiment provides a driving method of a display panel, by taking the OLED panel as an example of the display panel, the driving method provided by the present invention can allow the pixel units on the OLED panel to display alternately, and since the area of each pixel unit is relatively small with respect to the area of the whole OLED panel, such alternate display manner has a relatively small effect on the image display quality of the OLED panel. Meanwhile, compared to the driving method in the prior art, the driving method provided by the second embodiment allows lower power consumption of the OLED panel when display at the same brightness is achieved.

Figure 7:
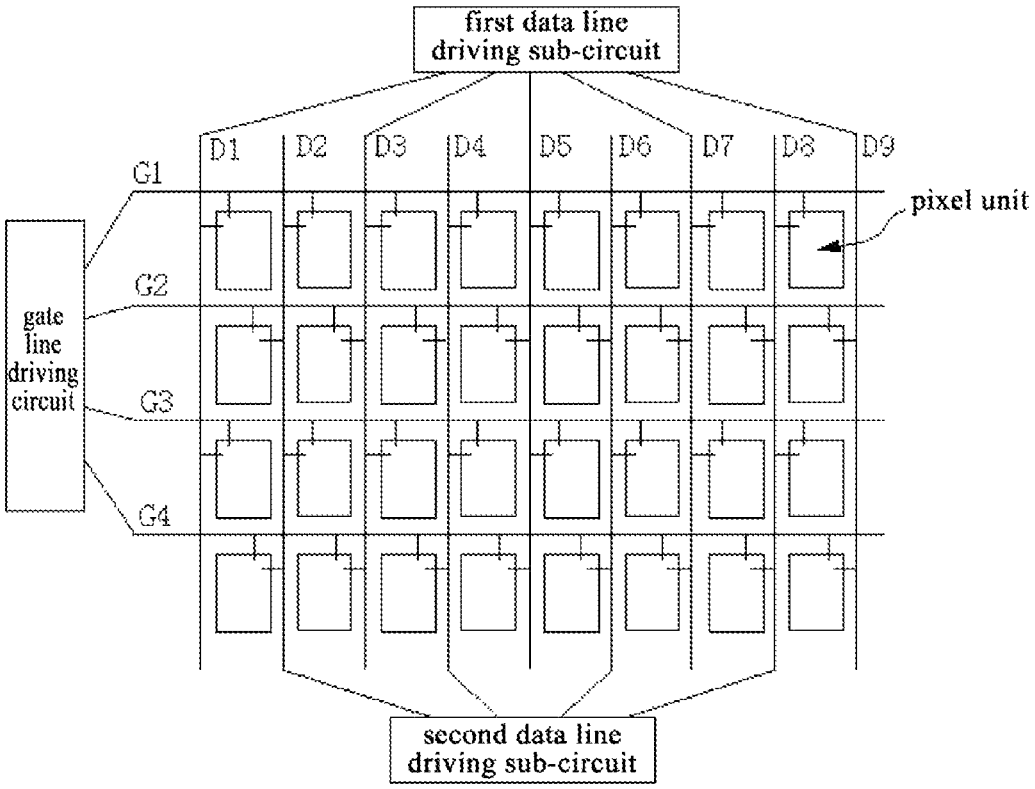
FIG. 7 is a schematic diagram of another OLED panel provided by an embodiment of the present invention.

FIG. 7 is a schematic diagram of another OLED panel provided by the present invention. The OLED display panel shown in FIG. 7 differs from the OLED display panel shown in FIG. 1 in that, in FIG. 7, each pixel unit in an odd row is connected to the data line at a first side thereof, each pixel unit in an even row is connected to the data line at a second side thereof, and the first side and the second side are the two sides of the pixel unit opposite to each other. In FIG. 7, the first side is the left side of the pixel unit, and the second side is the right side of the pixel unit.

The pixel units in the first and second rows (i.e., the pixel units connected to the gate lines G1 and G2) are taken as an example. In the pixel units in the first row (i.e., the pixel units connected to the gate line G1), the pixel unit in the first column is connected to the first data line D1, the pixel unit in the second column is connected to the second data line D2, the pixel unit in the third column is connected to the first data line D3, and so on. In the pixel units in the second row (i.e., the pixel units connected to the gate line G2), the pixel unit in the first column is connected to the second data line D2, the pixel unit in the second column is connected to first data line D3, the pixel unit in the third column is connected to the second data line D4, and so on. The pixel units in the third row are connected in the same manner as the pixel units in the first row, and the pixel units in the fourth row are connected in the same manner as the pixel units in the second row, which are not repeated herein.

Figure 8:
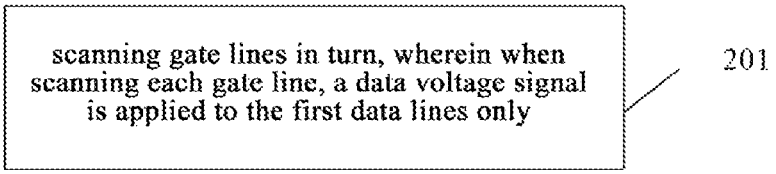
FIG. 8 is a flowchart of a driving method of the display panel shown in FIG. 7, provided by a third embodiment of the present invention.
Figure 9:
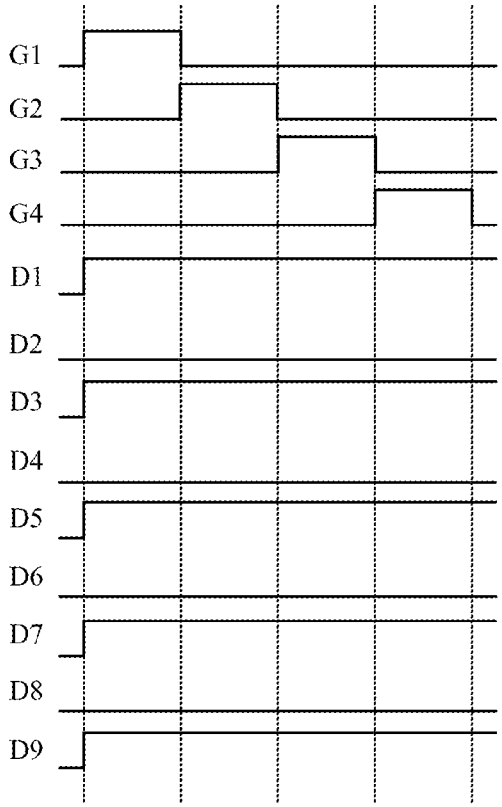
FIG. 9 is a timing diagram of the driving method shown in FIG. 8.

FIG. 8 is a flowchart of a driving method of the display panel shown in FIG. 7, provided by a third embodiment of the present invention, and FIG. 9 is a timing diagram of the driving method shown in FIG. 8. As shown in FIGS. 8 and 9, the driving method shown in FIG. 8 is used for driving the OLED panel shown in FIG. 7, and the driving method comprises:

step 201: scanning the gate lines G1 to G4 in turn, wherein when scanning each gate line, a data voltage signal is only applied to the first data lines.

Specifically, description will be given by taking the OLED panel shown in FIG. 7 as an example. The driving method provided by this embodiment comprises: scanning the gate lines G1 to G4 in turn.

When scanning the first gate line G1, the gate line driving circuit outputs a scanning signal, which is a high-level signal, to the gate line G1 to turn on the gate line G1, while the other gate lines are turned off. At this point, the pixel units in the first row (i.e., the pixel units connected to the gate line G1) are all in a data writable state. The first data line driving sub-circuit applies a data voltage signal to the first data lines D1, D3, D5, D7 and D9, while the second data line driving sub-circuit does not work, that is, no data voltage signal is applied to the second data lines D2, D4, D6 and D8. Therefore, among the pixel units in the first row, the data voltage can be written into the pixel units in odd columns (i.e., the first, third, fifth and seventh columns) only, and the pixel units in odd columns can perform display, whereas no data voltage can be written into the pixel units in even columns, and accordingly, the pixel units in even columns cannot perform display.

When scanning the second gate line G2, the gate line driving circuit outputs a scanning signal, which is a high-level signal, to the gate line G2 to turn on the gate line G2, while the other gate lines are turned off. At this point, the pixel units in the second row (i.e., the pixel units connected to the gate line G2) are all in a data writable state. The first data line driving sub-circuit applies a data voltage signal to the first data lines D1, D3, D5, D7 and D9, while the second data line driving sub-circuit does not work, that is, no data voltage signal is applied to the second data lines D2, D4, D6 and D8. Therefore, among the pixel units in the second row, the data voltage can be written into the pixel units in even columns (i.e., the second, fourth, sixth and eighth columns) only, and the pixel units in even columns can perform display, whereas no data voltage can be written into the pixel units in odd columns, and accordingly, the pixel units in odd columns cannot perform display.

When scanning the third gate line G3, the gate line G3 is turned on, at this point, only the first data line driving sub-circuit works, while the second data line driving sub-circuit does not work, therefore, among the pixel units in the third row, only the pixel units in odd columns can perform display, and the specific process is the same as the process of scanning the gate line G1 as described above and is not repeated herein.

When scanning the fourth gate line G4, the gate line G4 is turned on, at this point, only the first data line driving sub-circuit works, while the second data line driving sub-circuit does not work, therefore, among the pixel units in the fourth row, only the pixel units in even columns can perform display, and the specific process is the same as the process of scanning the gate line G2 as described above and is not repeated herein.

Figure 10:
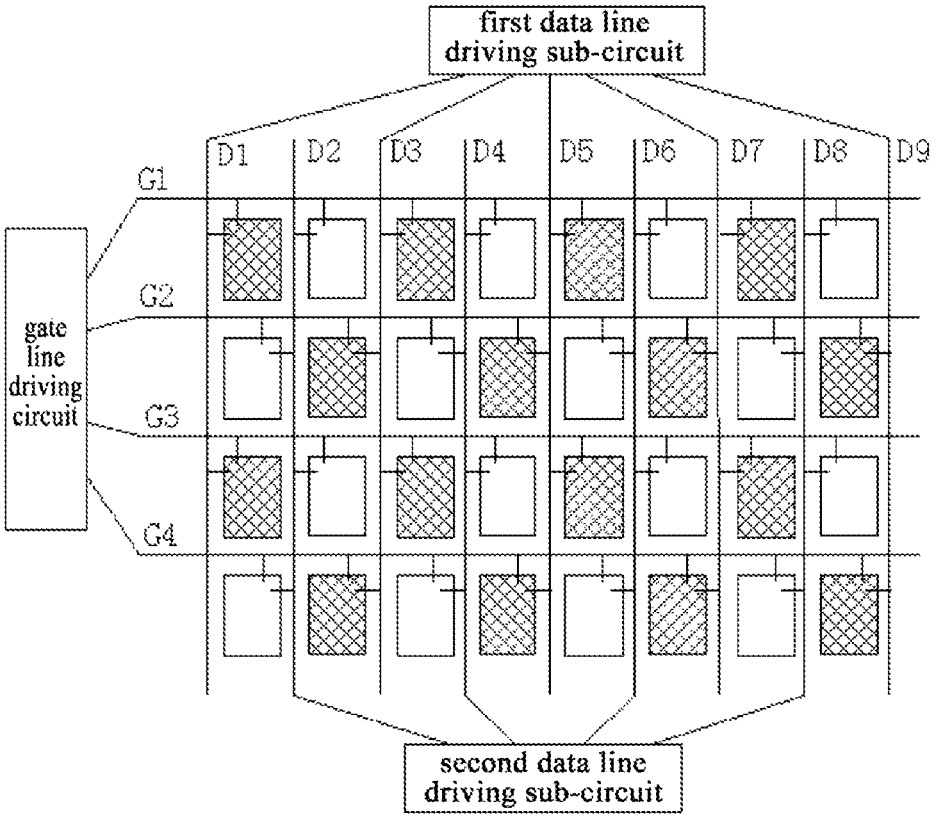
FIG. 10 is a schematic diagram illustrating an effect of driving the OLED panel shown in FIG. 7 by using the driving method shown in FIG. 8.

FIG. 10 is a schematic diagram illustrating an effect of driving the OLED panel shown in FIG. 7 by using the driving method shown in FIG. 8. As shown in FIG. 10, on the OLED panel, the pixel units in odd rows and odd columns and the pixel units in even rows and even columns (the blocks with checks in FIG. 10) can perform display, whereas the pixel units in odd rows and even columns and pixel units in even rows and odd columns (the blocks without checks in FIG. 10) cannot perform display. It can be seen that, the driving method provided by the third embodiment of the present invention can achieve exactly the same effect as the driving method provided by the second embodiment of the present invention.

The driving method provided by the third embodiment of the present invention differs from that provided by the second embodiment in that, no matter whether the odd-numbered gate line or the even-numbered gate line is being scanned, only the first data line driving sub-circuit works, while the second data line driving sub-circuit does not work. The reason why the driving methods provided by the third embodiment and the second embodiment are different but achieve the same effect is because the OLED panels respectively driven by the two driving methods have different structures.

On the premise of achieving the same brightness, comparison of power consumption between the driving method provided by the third embodiment and the driving method in the prior art can refer to the description in the second embodiment, and is not repeated herein.

Of course, when scanning each gate line, a data voltage signal may be applied to the second data lines only. In this case, on the OLED panel shown in FIG. 10, the pixel units in odd rows and odd columns and the pixel units in even rows and even columns (the blocks with checks in FIG. 10) cannot perform display, whereas the pixel units in odd rows and even columns and pixel units in even rows and odd columns (the blocks without checks in FIG. 10) can perform display.

The driving method provided by the third embodiment can allow the pixel units on the OLED panel to display alternately, and since the area of each pixel unit is relatively small with respect to the area of the whole OLED panel, such alternate display manner has a relatively small effect on the image display quality of the OLED panel. Meanwhile, compared to the driving method in the prior art, the driving method provided by the third embodiment allows lower power consumption of the OLED panel when display at the same brightness is achieved.

It should be noted that, in the second and third embodiments, the condition in which one first data line and one second data line are alternately arranged is described only, which is used as a preferable embodiment of the present invention and is not intended to limit the technical solutions of the present invention. Those skilled in the art should understand that, the present invention is also applicable to a condition in which a plurality of first data lines and a plurality of second data lines are alternately arranged, for example, in a case that two first data lines and two second data lines are alternately arranged, among the pixel units in one row, two successive pixel units that perform display and two successive pixel units that do not perform display are alternately arranged when the OLED panel is driven.

According to another aspect of the present invention, a fourth embodiment provides a driving circuit of a display panel, which is configured to drive the display panel. It should be noted that, an OLED panel is taken as an example of the display panel in this embodiment, but the driving circuit provided by this embodiment is not limited to being used for the OLED panel.

The OLED panel comprises: a plurality of gate lines and a plurality of data lines, the plurality of gate lines and the plurality of data lines define a plurality of pixel units, each of which is connected to one of the gate lines and one of the data lines, the data lines comprises: first data lines and second data lines, and a first predetermined number of first data line(s) and a second predetermined number of second data line(s) are alternately arranged; and the driving circuit of a display panel comprises: a gate line driving circuit connected to the gate lines, and a data line driving circuit connected to the first data lines and the second data lines; the gate line driving circuit is configured to apply a scanning signal to the gate line for scanning; and the data line driving circuit is configure to apply a data voltage signal to the first data lines or the second data lines when one of the gate lines is being scanned.

Optionally, the data line driving circuit comprises: a first data line driving sub-circuit and a second data line driving sub-circuit, the first data line driving sub-circuit is configured to apply a data voltage signal to the first data lines, and the second data line driving sub-circuit is configured to apply a data voltage signal to the second data lines.

The driving circuit of a display panel provided by this embodiment can be used for implementing the driving method provided by the first embodiment, the second embodiment or the third embodiment described above, and the detailed description of the working process of the driving circuit of a display panel can refer to the description in the first embodiment, the second embodiment or the third embodiment described above and is not repeated herein.

The driving circuit provided by the fourth embodiment can allow the pixel units on the OLED panel to display alternately, and since the area of each pixel unit is relatively small with respect to the area of the whole OLED panel, such alternate display manner has a relatively small effect on the image display quality of the OLED panel. Meanwhile, when the driving circuit provided by the fourth embodiment is used for driving the OLED panel, the power consumption of the OLED panel is relatively low.

According to still another aspect of the present invention, a fifth embodiment of the present invention provides a display device, which comprises a display panel and a driving circuit, wherein the display panel comprises: a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged; and the driving circuit is the driving circuit in the fourth embodiment described above.

It should be noted that, the "row" and "column" in the present invention may refer to the row and column shown in the accompanying drawings (e.g., FIGS. 1, 4, 7 and 10), but those skilled in the art should understand that when these accompanying drawings are rotated, for example, by 90 degrees, the "row" becomes the "column", and the "column" becomes the "row". Therefore, the "row" and "column" in the present invention include but is not limited to those shown in the accompanying drawings. Specifically, in the present invention, the extension direction of the gate line is considered as "row", and the extension direction of the data line is considered as "column".

It could be understood that the above implementations are only exemplary implementations for illustrating the principle of the present invention, but the present invention is not limited thereto. Various variations and improvements can be made by those skilled in the art without departing from the spirit and essence of the present invention, and these variations and improvements are also considered to be within the protection scope of the present invention.

The invention claimed is:

1. A driving method of a display panel, wherein the display panel comprises: a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged; the display panel further comprises a data line driving circuit comprising a first data line driving sub-circuit and a second data line driving sub-circuit, the first data line driving sub-circuit is configured to apply a data voltage signal to the first data lines, and the second data line driving sub-circuit is configured to apply a data voltage signal to the second data lines; wherein, the driving method comprises a step of:

scanning the plurality of gate lines in turn, wherein when scanning one gate line, only one of the first data line driving sub-circuit and the second data line driving sub-circuit operates so that a data voltage signal is applied only to the first data lines or only to the second data lines;

wherein, each pixel unit is connected to the data line located at a first side thereof; and the step of scanning the plurality of gate lines in turn, wherein when scanning one gate line, only one of the first data line driving sub-circuit and the second data line driving sub-circuit operates so that a data voltage signal is applied only to the first data lines or only to the second data lines comprises:

scanning the plurality of gate lines in turn, wherein when scanning an odd-numbered gate line, only the first data line driving sub-circuit operates so that the data voltage signal is applied only to the first data lines; and when scanning an even-numbered gate line, only the second data line driving sub-circuit operates so that the data voltage signal is applied only to the second data lines; or scanning the plurality of gate lines in turn, wherein when scanning an odd-numbered gate line, only the second data line driving sub-circuit operates so that the data voltage signal is applied only to the second data lines; and when scanning an even-numbered gate line, only the first data line driving sub-circuit operates so that the data voltage signal is applied only to the first data lines.

2. The driving method according to claim 1, wherein, the first predetermined number is equal to the second predetermined number.

3. The driving method according to claim 2, wherein, the first predetermined number is 1, 2 or 3; and the second predetermined number is 1, 2 or 3.

4. The driving method according to claim 3, wherein, the first predetermined number is 1, and the second predetermined number is 1.

5. The driving method according to claim 2, wherein, the first predetermined number is 1, and the second predetermined number is 1.

6. The driving method according to claim 1, wherein, the first predetermined number is 1, 2 or 3; and the second predetermined number is 1, 2 or 3.

7. The driving method according to claim 6, wherein, the first predetermined number is 1, and the second predetermined number is 1.

8. The driving method according to claim 1, wherein, the first predetermined number is 1, and the second predetermined number is 1.

9. A driving circuit of a display panel, for driving the display panel, wherein the display panel comprises: a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged;

the driving circuit of a display panel comprises: a gate line driving circuit connected to the plurality of gate lines, and a data line driving circuit connected to the first data lines and the second data lines, wherein the data line driving circuit comprises a first data line driving sub-circuit and a second data line driving sub-circuit, the first data line driving sub-circuit is configured to apply a data voltage signal to the first data lines, and the second data line driving sub-circuit is configured to apply a data voltage signal to the second data lines;

the gate line driving circuit is configured to scan the plurality of gate lines in turn, wherein when the gate line driving circuit scans one gate line, only one of the first data line driving sub-circuit and the second data line driving sub-circuit operates so that a data voltage signal is applied only to the first data lines or only to the second data lines;

wherein, each pixel unit is connected to the data line located at a first side thereof; and when the gate line driving circuit scans an odd-numbered gate line, only the first data line driving sub-circuit operates so that the data voltage signal is applied only to the first data lines; and when the gate line driving circuit scans an even-numbered gate line, only the second data line driving sub-circuit operates so that the data voltage signal is applied only to the second data lines; or when the gate line driving circuit scans an odd-numbered gate line, only the second data line driving sub-circuit operates so that the data voltage signal is applied only to the second data lines; and when the gate line driving circuit scans an even-numbered gate line, only the first data line driving sub-circuit operates so that the data voltage signal is applied only to the first data lines.

10. A display device, comprising a display panel and a driving circuit, wherein the display panel comprises: a plurality of gate lines and a plurality of data lines, which define a plurality of pixel units, each of which is connected to one of the gate lines and one of the data lines, the data lines comprises: first data lines and second data lines, and a first predetermined number of first data line(s) and a second predetermined number of second data line(s) are alternately arranged; and the driving circuit is the driving circuit of a display panel according to claim 9.

* * * * *